US006422976B1

(12) United States Patent
Eschenbach

(10) Patent No.: US 6,422,976 B1
(45) Date of Patent: Jul. 23, 2002

(54) COMPACT ELLIPTICAL EXERCISE MACHINE WITH ARM EXERCISE

(76) Inventor: Paul William Eschenbach, 143 Lakeland Ave., Moore, SC (US) 29369

( * ) Notice: Subject to any disclaimer, the term of this patent is extended or adjusted under 35 U.S.C. 154(b) by 3 days.

(21) Appl. No.: 09/685,873

(22) Filed: Oct. 11, 2000

Related U.S. Application Data

(63) Continuation-in-part of application No. 09/478,782, filed on Jan. 7, 2000, which is a continuation-in-part of application No. 09/067,261, filed on Apr. 27, 1998, now Pat. No. 6,142,915, which is a continuation-in-part of application No. 08/711,087, filed on Sep. 9, 1996, now Pat. No. 5,788,610.

(51) Int. Cl.[7] ..... A63B 69/16; A63B 22/04
(52) U.S. Cl. ..... 482/52; 482/51; 482/57
(58) Field of Search ..... 482/51, 52, 53, 482/57, 70, 79, 80

(56) References Cited

U.S. PATENT DOCUMENTS

| | | | | |
|---|---|---|---|---|
| 5,577,985 A | | 11/1996 | Miller | 482/52 |
| 5,611,756 A | | 3/1997 | Miller | 482/52 |
| 5,707,321 A | | 1/1998 | Maresh | 482/57 |
| 5,788,610 A | | 8/1998 | Eschenbach | 482/52 |
| 5,846,166 A | | 12/1998 | Kuo | 482/52 |
| 5,897,463 A | | 4/1999 | Maresh | 482/70 |
| 5,899,833 A | | 5/1999 | Ryan et al. | 482/52 |
| 5,993,359 A | * | 11/1999 | Eschenbach | 482/57 |
| 5,997,445 A | | 12/1999 | Maresh et al. | 482/70 |
| 6,019,710 A | | 2/2000 | Dalebout et al. | 482/70 |
| 6,045,487 A | * | 4/2000 | Miller | 482/52 |
| 6,099,439 A | | 8/2000 | Ryan et al. | 482/51 |

* cited by examiner

*Primary Examiner*—Stephen R. Crow

(57) ABSTRACT

The present invention relates to a standup exercise apparatus that simulates walking, jogging and climbing with arm exercise. More particularly, the present invention relates to an exercise machine having separately supported pedals for the feet and arm exercise coordinated with the motion of the feet.

Elliptical trainers guide the feet along a generally elliptical shaped curve to simulate the motions of jogging and climbing. Existing elliptical trainers often produce user problems such as a sensation of dropping off and consume excessive floorspace. The present invention is an improved elliptical exercise machine capable of extended exercise with fewer user problems without the dropping off sensation. Further, the elliptical trainer is more compact with a smaller footprint to conserve floor space.

The intermediate portion of a foot support member is guided by a guide member and drives a crank linkage on one end with pedal on the other end. The resulting pedal motion is foot friendly. Handles are connected to the crank linkage for coordinated arm exercise.

25 Claims, 3 Drawing Sheets

COMPACT ELLIPTICAL EXERCISE MACHINE WITH ARM EXERCISE

This application is a Continuation-in-Part of application Ser. No. 09/478,782 filed Jan. 7, 2000, which is a Continuation-in-Part of Ser. No. 09/067,261 filed Apr. 27, 1998, now U.S. Pat. No. 6,142,915, which is a Continuation-in-Part of Ser. No. 08/711,087 filed Sep. 9, 1996 issued U.S. Pat. No. 5,788,610.

BACKGROUND OF THE INVENTION

1. Field

The present invention relates to a standup exercise apparatus that simulates walking, jogging and climbing with arm exercise. More particularly, the present invention relates to an exercise machine having separately supported pedals for the feet and arm exercise coordinated with the motion of the feet.

2. State of the Art

The benefits of regular exercise to improve overall health, appearance and longevity are well documented in the literature. For exercise enthusiasts the search continues for safe apparatus that provides full body exercise for maximum benefit in minimum time.

Recently, a new category of exercise equipment has appeared on the commercial market called elliptical cross trainers. These cross trainers guide the feet along a generally elliptical shaped curve to simulate the motions of jogging and climbing. Generally they are large exercise machines using long cranks to generate a long foot stride. There is a need for a more compact elliptical exercise machine capable of a similar long stride using a linkage to modify the crank.

Recently, there has been an effort to improve the up and down motion of stair climbers by the addition of horizontal movements. Habing in U.S. Pat. Nos. 5,299,993 and 5,499,956 offers an articulated linkage controlled through cables by motor to move pedals through an ovate path. Both pedal pivots follow basically the same guidance path curve directed by a motor controller. Stearns in U.S. Pat. Nos. 5,290,211 and 5,299,993 shows a stair stepping exercise machine which incorporates horizontal movement using a combination of vertical parallelogram linkage and horizontal parallelogram linkage to guide the foot pedals. The parallelogram linkages serve to maintain the pedal at a constant angle relative to the floor during a pedal cycle. The pedal pivots move through similar undefined guide paths.

Standup cycling is described in various patents such as U.S. Pat. No. 3,563,541 (Sanquist) which uses weighted free pedals as load resistance and side to side twisting motion. Also U.S. Pat. Nos. 4,519,603 and 4,477,072 by DeCloux describe standup cycling with free pedals in a lift mode to simulate body lifting. Eschenbach in U.S. Pat. No. 5,279,529 shows several embodiments of elliptical pedal motion configured to maintain the heel of the user on the pedal during a substantial portion of the pedal cycle.

Standup pedal exercise is shown in U.S. Pat. No. 4,643,419 (Hyde) and by Jarriel et al. In U.S. Pat. No. D330,236 where pedal platforms move by dual crank motion but remain parallel to the floor. Knudsen in U.S., Pat. No. 5,433,680 shows an elliptical path generating mechanism with pedals having only one pivot allowing the pedal to rotate unconstrained about the pivot as in a bicycle crank.

Standup pedal exercise combined with arm levers attached to the pedals is shown in Kummerlin et al. German Pat. No. 2,919,494 and in Geschwender U.S. Pat. No. 4,786,050. Standup pedal exercise coupled with oscillating swing arms is shown in Miller U.S. Pat. Nos. 5,242,343 and 5,383,829 and in Eschenbach U.S. Pat. No. 5,423,729. All of these exercise machines use pedals having two pedal pivots which are guided by a first circular guide path curve generated by a crank which rotates through one full revolution during a pedal cycle and a second arc guide path curve generated by a rocker link or track.

Recently, numerous elliptical exercise machines have appeared in the patent literature. Rogers,Jr. in U.S. Pat. Nos. 5,527,246, 5,529,555, 5,540,637, 5,549,526, 5,573,480, 5,591,107, 5,593,371, 5,593,372, 5,595,553, 5,611,757, 5,637,058, 5,653,662 and 5,743,834 shows elliptical pedal motion by virtue of various reciprocating members and geared linkage systems. Miller in U.S. Pat. Nos. 5,518,473, 5,562,574, 5,611,756, 5,518,473, 5,562,574, 5,577,985, 5,755,642 and 5,788,609 also shows elliptical pedal motion using reciprocating members and various linkage mechanisms along with oscillating guide links with control links to determine pedal angles. Ryan et al. in U.S. Pat. No. 5,899,833 shows an elliptical cross trainer having a forward crank driving a pedal linkage underneath the operator.

Chang in U.S. Pat. No. 5,803,872 and Yu et al. in U.S. Pat. No. 5,800,315 show a pedal supported by a rocker link and driven with a pair of links located under the pedal pivotally connected to a crank. Maresh et al. in U.S., Pat. No. 5,792,026 show a foot support member supported by a rocker link and driven by a double crank mechanism. Maresh in U.S. Pat. No. 5,897,463 shows a foot platform with parallel movement as the the foot platform follows an oval path. Lee in U.S. Pat. No. 5,779,598 and Chen in U.S. Pat. No. 5,823,914 show a pedal link driven by two separate cranks. Lin et al. in U.S. Pat. No. 5,769,760 offers elliptical foot and hand motion. Sands et al. U.S. Pat. No. 5,755,643 shows elliptical foot motion with folding front post.

Lee in U.S. Pat. No. 5,746,683 shows a foot support member supported on one end with a compound rocker wherein a slider and handle lever support the rocker. Kuo in U.S. Pat. No. 5,836,854 offers a linear foot support member connected on one end to a crank and guided along an arcuate curve under the pedal by a linkage on the other end. Wang et al. U.S. Pat. No. 5,830,112 shows a foot support member sliding on a pivot on one end and attached to a crank on the other that can fold. Chen U.S. Pat. No. 5,823,917 shows a foot support member driven by a crank on one end and supported by a stationary roller on the other. Chen U.S. Pat. No. 5,820,524 offers a slider crank mechanism having a pedal pivotally attached with a control link to articulate the pedal angle.

Chen U.S. Pat. Nos. 5,779,599 and 5,762,588 shows an elliptical pedal movement with a roller interface between the foot support member and crank. Chen in U.S. Pat. No. 5,759,136 shows a foot support member with a moving pedal for adjustable elliptical motion wherein a link from the pedal to the crank can be repositioned to change the pedal stroke length. Kuo U.S. Pat. No. 5,846,166 shows a foot support member guided on one end by a a roller and driven on the other end by a four bar linkage. Stearns et al. in U.S. Pat. No. 5,848,954 offers a foot support member pivoted on one end with a lift crank on the other and a pedal moving on the foot support member to generate elliptical type foot motion.

Maresh et al. in U.S. Pat. Nos. 5,893,820 and 5,997,445 shows an adjustable lift elliptical cross trainers. Kuo U.S. Pat. No. 5,836,854 shows a foot support member driven by a crank and guided on one end by a linkage hanging from a "Z" shaped bar that may be adjusted. Whan-Tong et al. in U.S. Pat. No. 5,685,804 shows a foot support member driven by a simple crank having an adjustable ramp to vary pedal lift. Eschenbach in U.S. Pat. No. 5,692,994 shows an elliptical cross trainer which has an adjustable upright support member which allows variable pedal motion.

There is a need for a compact pedal operated exercise machine that can be safely operated in the standup position whereby the arms and legs can be exercised with the feet moving through a generally elliptical movement without the dropping off sensation.

It is one objective of this invention to provide an elliptical pedal movement with a crank linkage that provides a compact and simple exercise machine with a small footprint. Another object of this invention is to provide an oblong pedal path wherein a portion of the lower half is flat to overcome the dropping off sensation characteristic of certain elliptical trainers. Yet another object of this invention is to provide arm exercise that is coordinated with the pedal movement.

SUMMARY OF THE INVENTION

The present invention relates to the kinematic motion control of pedals which simulate running, climbing and cycling during several modes of operation. More particularly, apparatus is provided that offers variable intensity exercise through a leg operated cyclic motion in which the pedal supporting each foot is guided through successive positions during the motion cycle while a load resistance acts upon the mechanism.

The pedals are guided through an oblong or elongate curve motion while pedal angles vary during the pedal cycle to maintain the heel of the foot in contact with the pedal. As the foot is raised, the heel of the foot remains generally in contact with the inclining pedal for safer operation. Arm exercise is by arm levers coordinated with the mechanism guiding the foot pedals.

In the preferred embodiment, the apparatus includes a separate pedal for each foot, each pedal being extended by a foot support member and partially supported by an oblong guide path curve for the first foot support member portion at a foot support pivot. The oblong guide path generating mechanism has a rotary crank which completes one full revolution during a pedal cycle and is phased generally opposite the crank for the other pedal through a crankshaft bearing housing attached to the framework. A rocker link is pivotally connected to the framework. A coupler link is connected to the crank at a crank pivot and the rocker link is connected to the coupler link at a rocker pivot to form a path generating mechanism. The coupler link is connected to the foot support member at a foot support pivot in the portion that follows an oblong guide path curve.

The foot support member is supported at a second foot support member portion with a pivot by foot support guides configured as rollers supported by tracks attached to the framework. As the crank is driven by foot motion, the pedal follows an elongate curve approximating an ellipse having a flat portion in the lower part of the ellipse to avoid the drop off sensation common to elliptical trainers.

Arm exercise is provided with handles pivotally connected to the framework. A connecting link is pivotally connected to each handle and each coupler link between the foot support member and the rocker to coordinate the arm movement with the foot. When the foot is forward, the handle corresponding to that foot is generally rearward.

Load resistance is imposed upon the crank through pulleys and chain from a flywheel having a friction belt around a portion of the circumference. Adjustment of belt tension varies the load resistance either by manual or actuator adjustment. The actuator can varied during operation through a control system within easy reach of the operator. Other forms of load resistance such as alternator, magnetic, air, belt, etc. may also be used.

In an alternate embodiment, the coupler links form irregular shapes to accommodate the rocker pivot positioned offset relative to a line connecting the crank pivot and the foot support pivot. The offset rocker pivot causes the pedal movement to change. The crank, rocker, foot support members, track supports and load resistance are similar to the preferred embodiment.

In summary, this invention provides the operator with stable foot pedal support having motions that simulate running, climbing and cycling with very low joint impact and upper body exercise in a compact space. The pedal motion avoids the dropping off sensation common to elliptical trainers.

DETAILED DESCRIPTION OF THE EMBODIMENTS

Figure 1:
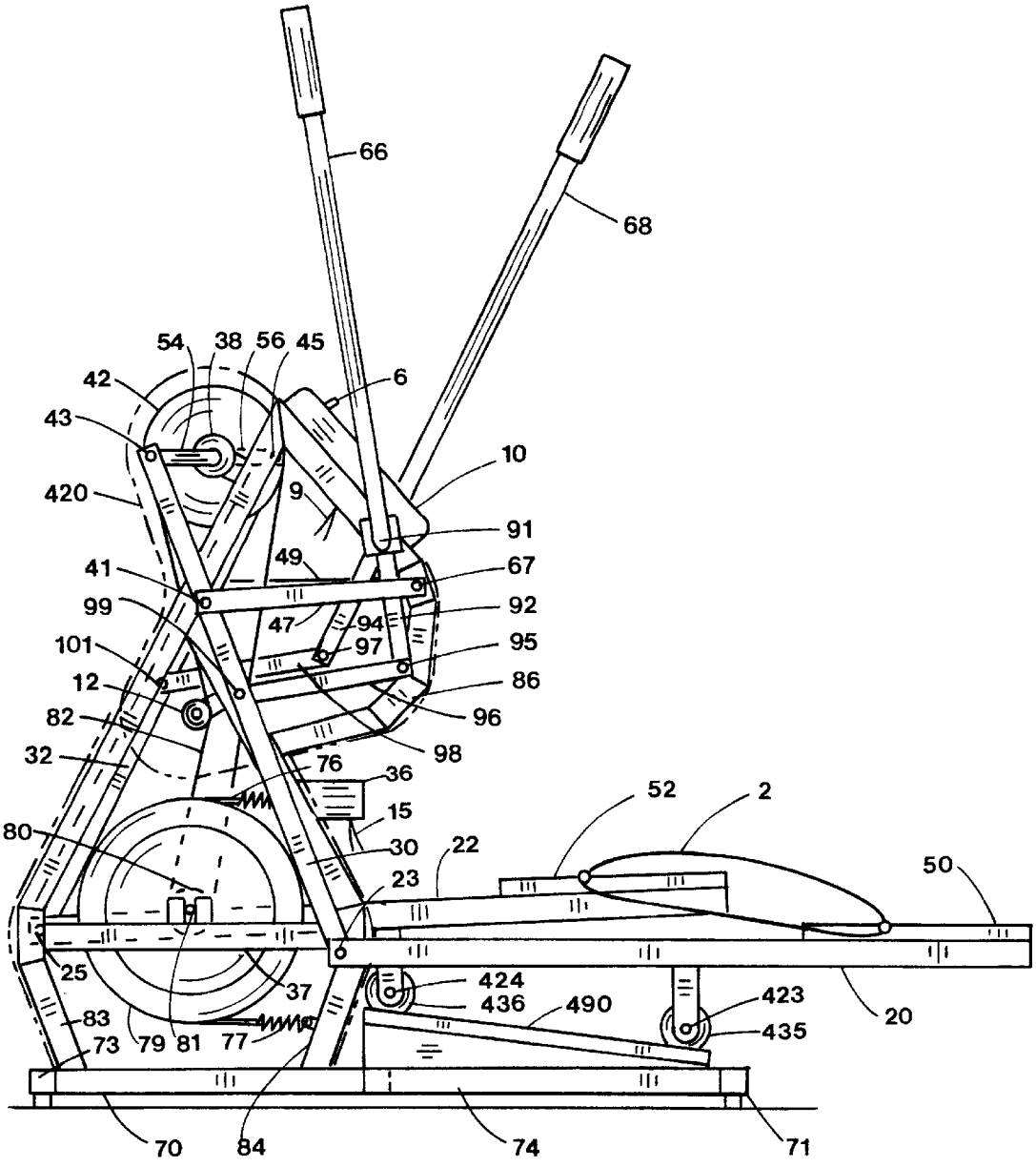
FIG. 1 is a right side elevation view of the preferred embodiment of an exercise machine constructed in accordance with the present invention.
Figure 2:
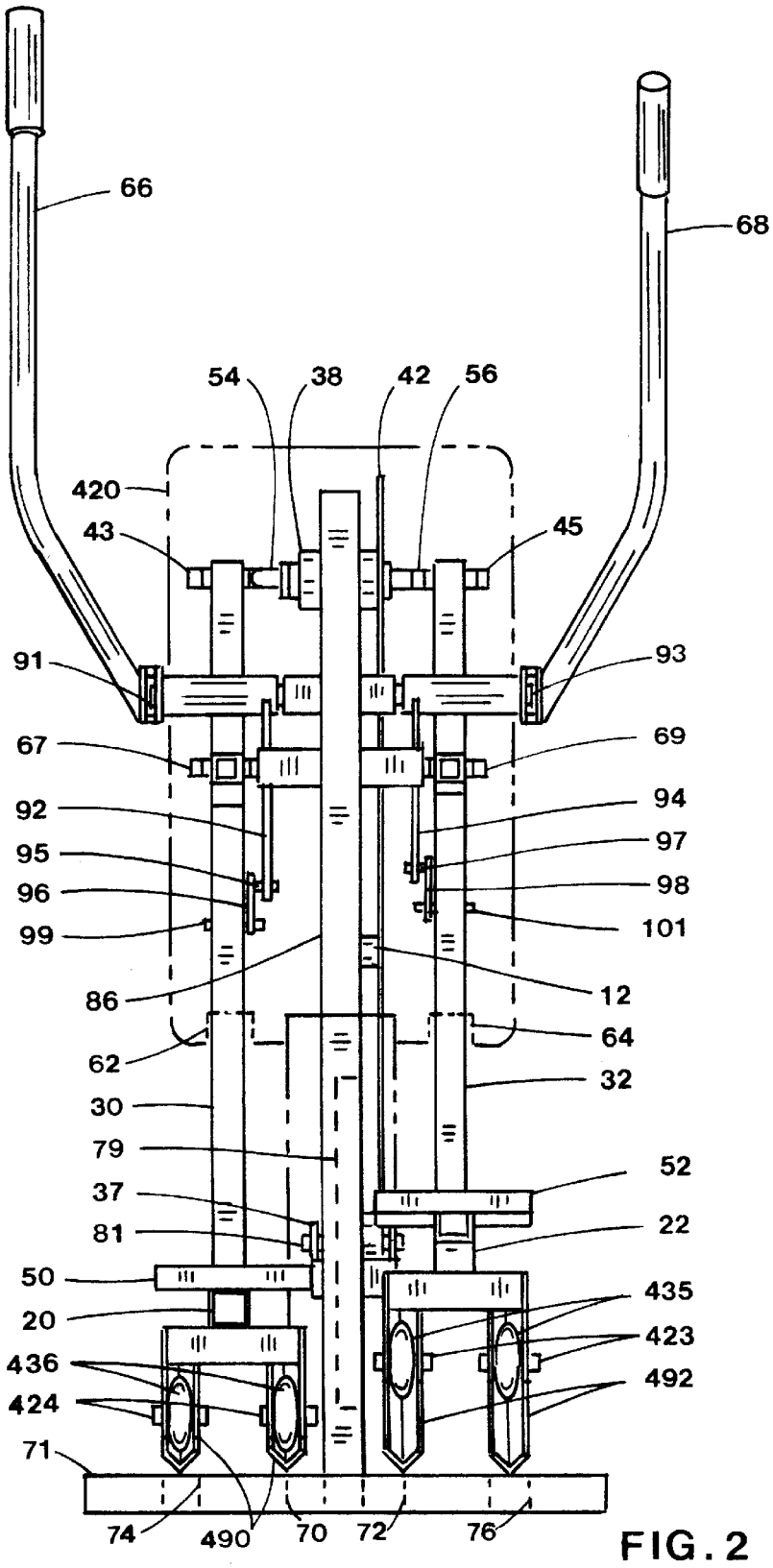
FIG. 2 is the rear view of the preferred embodiment shown in FIG. 1.

Referring to the drawings in detail, pedals 50 and 52 are shown in FIGS. 1 and 2 in the most forward and rearward positions of the first embodiment. Pedals 50 and 52 are supported by foot support members 20 and 22 which have first foot support pivots 23,25 in a first portion and second foot support pivots 423,424 in a second portion, respectively. Foot support pivots 23 and 25 are pivotally attached to coupler links 30 and 32 which guide pedal pivots 23 and 25 along an oblong guide path curve similar to guide path curve 4 shown in FIG. 3. Coupler link 30 is connected to rocker link 47 at rocker pivot 41 and to crank 54 at crank pivot 43 while coupler link 32 is connected to rocker link 49 at rocker pivot 44 and to crank 56 at crank pivot 45. Cranks 54 and 56 are connected in opposing directions by crankshaft journal 55 (not shown) which is rotatably secured to the framework by bearing housing 38. Rocker links 47 and 49 are pivotally attached to support member 86 at pivots 67 and 69, respectively. Handles 66,68 are attached to support member 86 at pivots 91,93 for arm exercise. Handle extensions 92,94 are offset relative to handles 66,68 inside shroud 420. Connector links 96,98 are connected to handle extensions 92,94 by pivots 95,97 and to coupler links 30,32 at pivots 99,101.

Tracks 490,492 are supported by framework members 70,72,74,76. Rollers 435,436 are attached to foot support members 20,22 in a second portion at pivots 423,424 and in rollable contact with tracks 490,492 for back and forth movement.

Frame members 70 and 72 are attached to crossover members 71,73 configured to be supported by the floor. Frame members 83,84 are attached to frame members 70,72 and support crank housing 38. Support member 86 is attached to frame members 83,84. Shroud 420 is attached to support member 86 and frame member 83 to encompass the cranks 54,56, upper portions of coupler links 30,32 handle extensions 92,94 and connector links 96,98. The lower portions of couplers 30,32 protrude from slots 62,64 of shroud 420.

Flywheel 79 is rotatably supported at pivot 81 which is journaled to flywheel support members 37,39 which are connected to frame members 83,84. Load resistance is imposed upon crank 54 by sprocket 42 which is connected to a smaller sprocket 80 by chain 82 to drive the flywheel 79. Friction belt 76 applies frictional resistance to flywheel 79 rotation by actuator 36 attached to frame member 84. Load resistance is varied by actuator 36 to vary the length of springs 77.

Control system 10 is attached to support member 86. Wires 9 are connected to actuator wires 15 by conventional means not shown. The switch 6 can be manually changed during operation by the operator to vary load intensity or by automatic program.

Application of body weight on the pedals 50,52 and force applied at the arm levers 66,68 cause the flywheel 79 to rotate for a gain in momentum while the pedals 50,52 follow the pedal curve 2. Oblong curve 2 has a flat portion on the lower half of the curve to reduce a dropping off sensation common with elliptical trainers. The flywheel 79 momentum will carry the linkage system through any dead center positions of the crank 54,56. The pedals 50,52 and arm levers 66,68 can be operated to drive the flywheel 79 in either direction of rotation.

Figure 3:
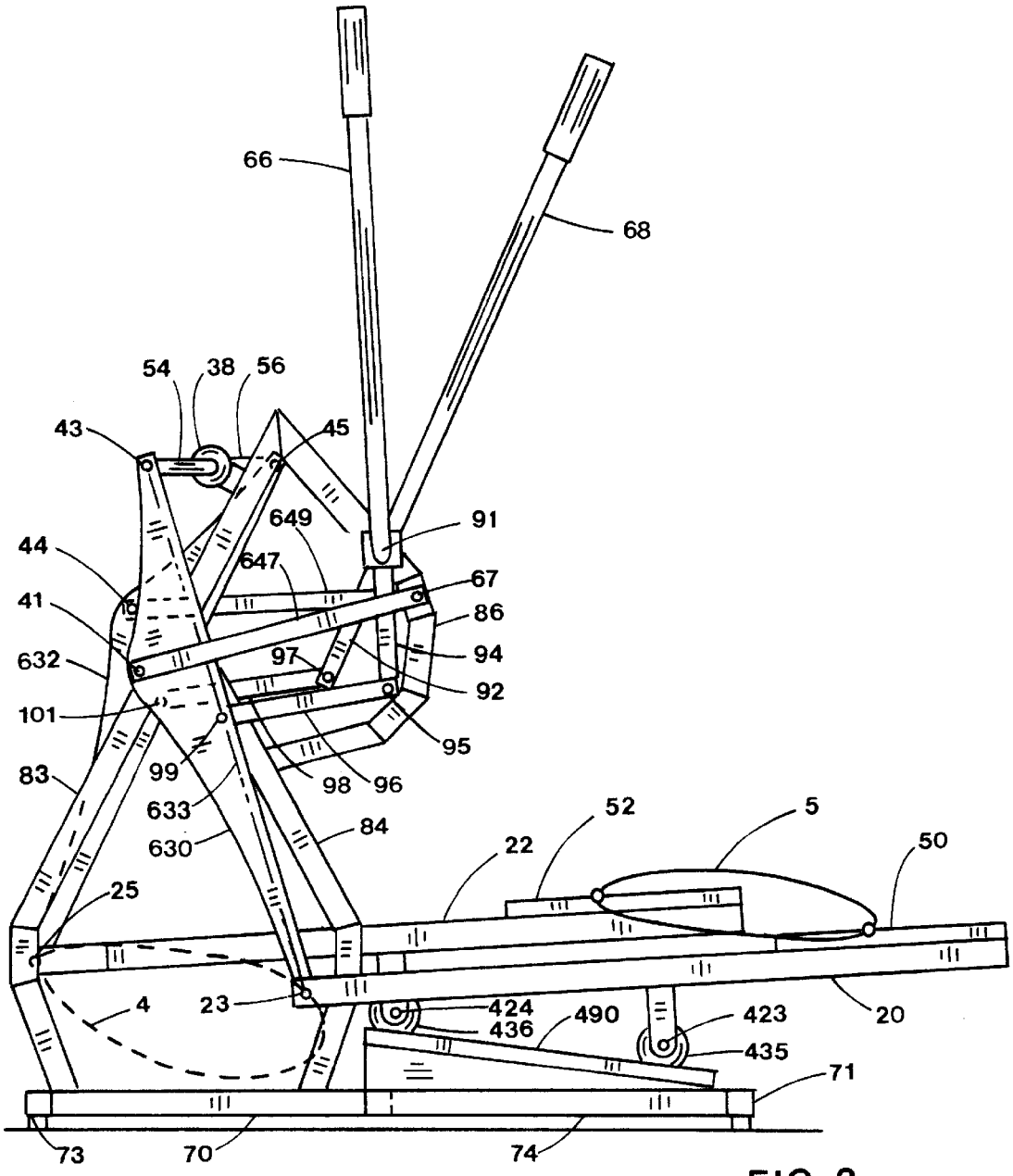
FIG. 3 is is a side elevation view of an alternate embodiment of the present invention.

In an alternate embodiment, pedals 50,52 are shown in the most forward and rearward positions in FIG. 3. Coupler links 630,632 take on an irregular shape because rocker pivots 41,44 are positioned offset relative to a line 633 connecting crank pivots 43,45 and foot support pivots 23,25. Rockers 647,649 connected to pivots 41,44 and 67,69 are longer than the preferred embodiment. The resultant pedal curve 5 is different than the pedal curve 2 of the preferred embodiment. The other components are similar to the preferred embodiment. The load resistance flywheel 79, drive elements 42,82,80, controls 10 and actuator 36 are not shown for clarity.

The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise machine comprising:

a framework, said framework configured to be supported by the floor;

a pair of foot support members, each having a first portion, a second portion and a foot engaging pedal;

a crank, said crank rotatably attached to said framework projecting outwardly therefrom on both sides thereof;

a pair of linkages, each said linkage including a rocker link pivotally connected to said framework and, a coupler link operably associated with said crank and said rocker link, said linkage configured to guide said first portion of said foot support member;

a pair of guides, each said guide operably associated with said foot support member and said framework to cause said second portion of said foot member to have a back and forth movement;

said pedal configured to move relative to said framework when the foot of the user is rotating said crank whereby said pedal follows an oblong curve path with non-parallel angular pedal movement.

2. The exercise machine according to claim 1 wherein said oblong curve path is generally elliptical in shape.

3. The exercise machine according to claim 1 wherein said guide comprises a track, said track attached to said framework and, a roller, said roller rotatably connected to said second portion of said foot support member and in rollable contact with said track.

4. The exercise machine according to claim 1 further comprising a means for arm exercise, said means for arm exercise operably associated with said linkage.

5. The exercise machine according to claim 4 wherein said means for arm exercise comprises a pair of handles, each said handle pivotally connected to said framework and a pair of connector links, each said connector link operably associated with said handle and said corresponding coupler link.

6. The exercise machine according to claim 1 further comprising a flywheel, said flywheel rotatably connected to said framework and operably associated with said crank.

7. The exercise machine according to claim 6 further comprising a load resistance, said load resistance operably associated with said flywheel, a means for adjustment of said load resistance and, a control system, said control system positioned within reach of the operator whereby said load resistance can be varied during operation of said exercise machine.

8. The exercise machine according to claim 1 wherein said foot support member is configured with said pedal on one end and said first portion at the other end with said second portion positioned intermediate the ends.

9. The exercise machine according to claim 3 wherein said track is inclined relative to said floor.

10. The exercise machine according to claim 1 wherein said crank is pivotally connected to one end of said coupler link and said first portion of said foot support member is pivotally connected to the other end of said coupler link.

11. The exercise machine according to claim 1 wherein said crank is connected to said coupler link at a crank pivot, said foot support member is connected to said coupler link at a foot support pivot and, said rocker link is connected to said coupler at a rocker pivot positioned offset relative to a line connecting said crank pivot and said foot support pivot.

12. The exercise machine according to claim 1 wherein said oblong curve path has a flat portion, said flat portion positioned on the lower half of said oblong curve path.

13. The exercise machine according to claim 1 further comprising a shroud, said shroud encompassing said crank, said rockers and a first portion of said coupler links whereby a second portion of said coupler links protrudes from said shroud to guide said foot support members.

14. An exercise machine comprising:

a framework, said framework configured to be supported by the floor;

a pair of foot support members, each having a first portion, a second portion and a foot engaging pedal;

a crank, said crank rotatably attached to said framework projecting outwardly therefrom on both sides thereof;

a pair of rocker links, each said rocker link pivotally connected to said framework;

a pair of coupler links, each said coupler link connected to said rocker link at a rocker pivot and to said crank at a crank pivot to support said first portion of said foot support member at a foot support pivot;

a pair of guides, each said guide operably associated with said foot support member and said framework to cause said second portion of said foot member to have a back and forth movement;

a pair of handles for arm exercise, each said handle pivotally connected to said framework;

a pair of connector links, each said connector link operably associated with said handle and said corresponding coupler link;

said pedal configured to move relative to said framework when the foot of the user is rotating said crank whereby said pedal follows an oblong curve path.

15. The exercise machine according to claim 14 wherein said crank is connected to one end of said coupler link at said crank pivot and said first portion of said foot support member is connected to the other end of said coupler link at said foot support pivot.

16. The exercise machine according to claim 14 wherein said coupler link has said rocker pivot positioned offset relative to a line connecting said crank pivot and said foot support pivot.

17. The exercise machine according to claim 14 wherein said oblong curve path has a flat portion, said flat portion positioned on the lower half of said oblong curve path.

18. The exercise machine according to claim 14 wherein said connector link is pivotally connected to said coupler link between said rocker pivot and said foot support pivot.

19. The exercise machine according to claim 14 wherein said guide comprises a track, said track attached to said framework and, a roller, said roller rotatably connected to said second portion of said foot support member and in rollable contact with said track.

20. An exercise machine comprising:

a framework, said framework configured to be supported by the floor;

a pair of foot support members, each having a first portion, a second portion and a foot engaging pedal;

a crank, said crank rotatably attached to said framework projecting outwardly therefrom on both sides thereof;

a pair of rocker links, each said rocker link operably associated with said framework;

a pair of coupler links, each said coupler link having said rocker link connected intermediate the ends at a rocker pivot and having said crank connected proximate one end of said coupler link at a crank pivot such that the other end of said coupler link guides said first portion of said foot support member at a foot support pivot;

a pair of tracks, each said track operably associated with said foot support member and said framework to cause said second portion of said foot support member to have a back and forth movement;

said pedal configured to move relative to said framework when the foot of the user is rotating said crank whereby said pedal follows an oblong curve path.

21. The exercise machine according to claim 20 further comprising a roller, said roller rotatably attached to said second portion of said foot support member and rollably associated with said track.

22. The exercise machine according to claim 20 wherein said track is inclined relative to said floor.

23. The exercise machine according to claim 20 wherein said coupler link has said rocker pivot positioned offset relative to a line connecting said crank pivot and said foot support pivot.

24. The exercise machine according to claim 20 wherein said oblong curve path has a flat portion, said flat portion positioned on the lower half of said oblong curve path.

25. The exercise machine according to claim 20 further comprising a pair of handles, each said handle pivotally connected to said framework and, a pair of connector links, each said connector link operably associated with said handle and said corresponding coupler link.

* * * * *